United States Patent [19]

Goettl

[11] Patent Number: 4,950,393

[45] Date of Patent: Aug. 21, 1990

[54] OPERATIVELY STATIONARY POOL CLEANING APPARATUS

[75] Inventor: John M. Goettl, Phoenix, Ariz.

[73] Assignee: Lewis D. Ghiz, Tempe, Ariz.

[21] Appl. No.: 330,193

[22] Filed: Mar. 29, 1989

[51] Int. Cl.[5] ..... E04H 4/16; B08B 9/08

[52] U.S. Cl. ..... 210/169; 210/416.2; 15/1.7; 134/167 R

[58] Field of Search ..... 210/169, 416.2; 15/1.7; 134/167 R

[56] References Cited

U.S. PATENT DOCUMENTS

| | | | |
|---|---|---|---|
| 3,032,044 | 5/1962 | Pansini | 134/167 R |
| 3,063,077 | 11/1962 | Pansini | 210/169 |
| 3,078,998 | 2/1963 | Blumenfeld | 15/1.7 |
| 3,108,298 | 10/1963 | Gelinas | 134/167 R |
| 3,291,145 | 12/1966 | Arneson | 134/167 R |
| 3,444,575 | 5/1969 | Martin | 15/1.7 |
| 3,689,408 | 9/1972 | Edmiston et al. | 15/1.7 |
| 3,712,313 | 1/1973 | Koble et al. | 15/1.7 |
| 3,765,432 | 10/1973 | Goodin | 15/1.7 |
| 3,794,052 | 2/1974 | Koble, Jr. et al. | 134/167 R |
| 3,797,508 | 3/1974 | Jacobs | 134/167 R |
| 3,822,754 | 7/1974 | Henkin et al. | 15/1.7 |
| 3,932,281 | 1/1976 | Pansini | 210/169 |
| 3,936,899 | 2/1976 | Henkin et al. | 15/1.7 |
| 3,961,393 | 6/1976 | Pansini | 15/1.7 |
| 4,233,702 | 11/1980 | Zweifel | 210/169 |
| 4,240,173 | 12/1980 | Sherrill | 15/1.7 |
| 4,338,697 | 7/1982 | Broadwater | 15/1.7 |
| 4,589,986 | 5/1986 | Greskovics et al. | 15/1.7 |
| 4,626,358 | 12/1986 | Fetsko | 210/776 |
| 4,654,916 | 4/1987 | Postonen et al. | 15/1.7 |
| 4,692,956 | 9/1987 | Kassis | 15/1.7 |
| 4,722,670 | 2/1988 | Zweifel | 210/169 |
| 4,749,478 | 6/1988 | Brooks | 210/169 |
| 4,781,827 | 11/1988 | Shields | 210/169 |

OTHER PUBLICATIONS

Polaris Vac-Sweep Model 180, SL-1, 10/1984.
Polaris Vac-Sweep 360, Alopex Ind., 1987.
Arneson Pool Sweep II, AP5-150.
Pool Tender, PLI Products 01-999-0220.
Jandy Ray-Vac Automatic Pool Vacuum, J1, 1/1985, 10M.
Porpoise Automatic Pool Cleaner, Jandy Industries.
Jandy Leaf Master.

*Primary Examiner*—W. Gary Jones

[57] ABSTRACT

A pool cleaning apparatus weighted to rest on a pool bottom. The apparatus includes a manifold for discharging water under pressure into a plurality of sweep hoses and into a plurality of venturi jets. The sinuous action of the sweep hoses places small foreign particles in suspension, and tends to draw larger debris such as leaves toward the inner ends of the hoses. The jets discharge into a venturi chamber which is spaced above the pool bottom by support legs. This induces a flow of pool water into the venturi chamber, carrying the larger debris through the venturi chamber for collection in a removable debris or leaf bag.

10 Claims, 2 Drawing Sheets

FIG. 1
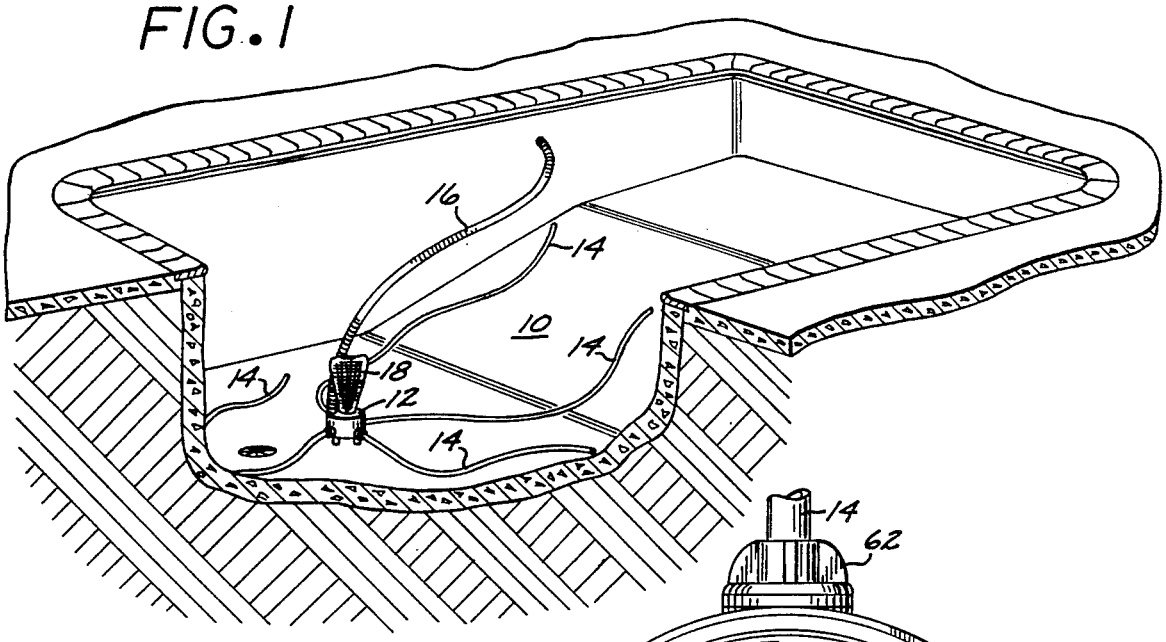
FIG. 2
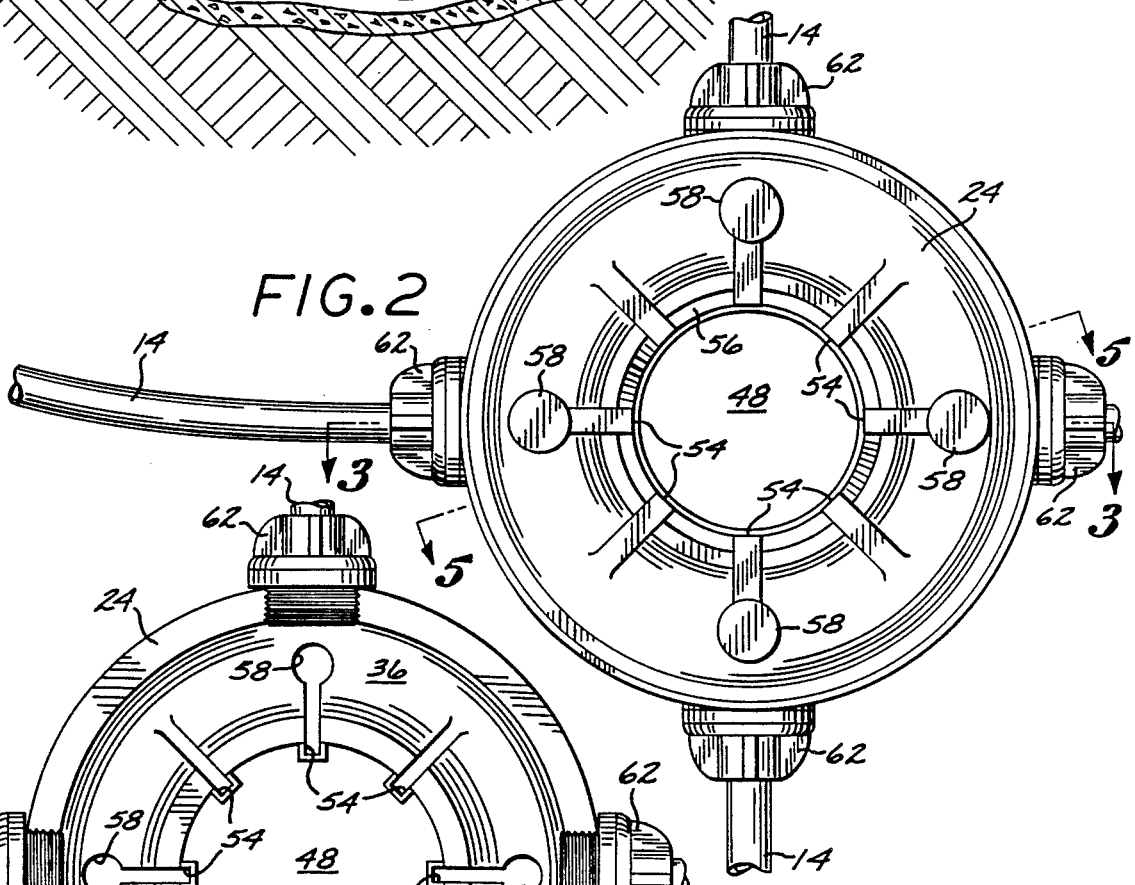
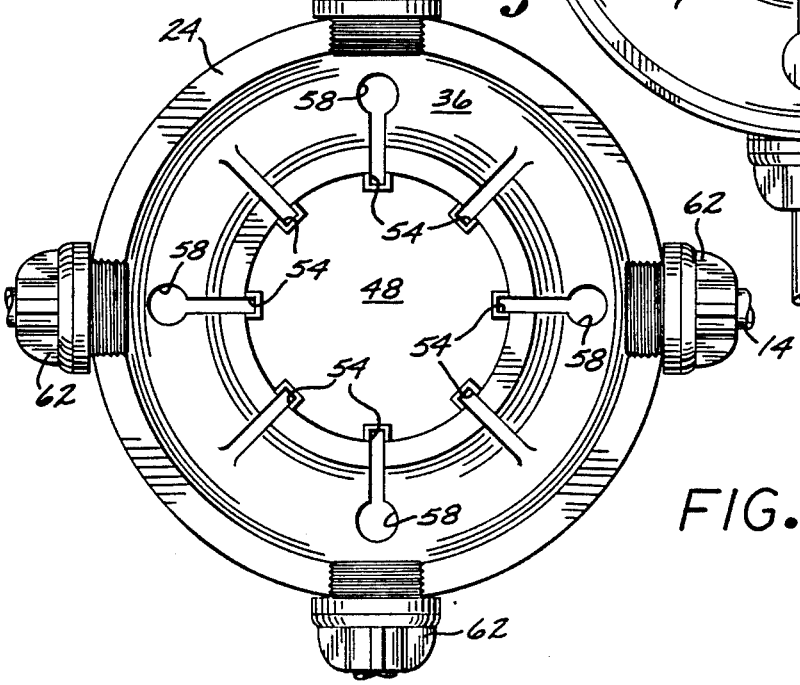
FIG. 4

OPERATIVELY STATIONARY POOL CLEANING APPARATUS

BACKGROUND OF THE INVENTION

1. Field of the Invention:

The present invention relates to a non-mobile pool cleaning apparatus which places smaller debris particles in suspension and draws larger debris into a venturi chamber for collection.

2. Related Art

The use of one or more flexible, jet reactive sweep hoses in mobile pool cleaning devices is well known. Water under pressure is discharged through the hose ends, causing them to whip about and brush or sweep over the pool bottom, while at the same time some of the pressurized water is used to drive the device over the pool bottom and sides. This places small foreign particles or debris in suspension in the pool water so that it can be drawn away by the usual pool bottom main drain for filtration. U.S. Pat. No. 3,291,145 (H. M. Arneson) is directed to such a device. Larger debris items such as leaves eventually find their way to the main drain, where the debris is typically caught in a leaf trap placed over the drain. The leaf trap must be periodically lifted to the surface and emptied.

Alternatively, vacuum sweep devices can be used to collect the leaves, as shown, for example, in U.S. Pat. No. 4,240,173 (Sherrill). Water is forced through such a device to create a venturi action which sucks the leaves up into a leaf bag. The device must be rolled over the pool surfaces to reach the scattered leaves, which is an awkward chore because it requires manipulation of a long pole attached to the device.

Other mobile devices have been devised which both sweep small debris into suspension and also collect larger debris in a compartment or bag. U.S. Pat. No. 4,589,986 (Greskovics et al) is exemplary of this type of device.

The mechanisms for automatically moving such cleaning devices over pool surfaces tend to be somewhat complex and expensive, and therefore are particularly unsuited for use in low cost above-ground pool installations. Also, they often require expensive booster pumps to operate satisfactorily.

As a consequence, operatively stationary pool cleaning devices were developed which use one or more sweep hoses to place small debris in suspension. It was found that leaves and other larger debris tended to be drawn toward the root or fixed ends of the sweep hoses. Apparently, the turbulence present at the free ends of the whipping hoses induces leaves and the like to move to the less turbulent areas at the hose inner ends. Such an operatively stationary pool cleaning device is disclosed in U.S. Pat. No. 3,794,052 (Koble and Goettl).

As explained in that patent, the device is only stationary in the sense that it is not moved while it is cleaning a particular area, but if the area to be cleaned is large enough, the device is manually pulled or relocated by the operator to another, uncleaned area. When an area has been cleaned, the larger debris will have collected in a small area adjacent the device, where it can readily be collected by vacuuming it into a leaf bag after the device is moved out of the way to a new area. To facilitate collection of leaves and the like the device was sometimes placed in the center of a shallow leaf trap having an apertured bottom and sloping sides. The leaves would then collect in the trap. When the cleaning device was moved to a new location, the trap was raised to the surface and emptied. there are a number of disadvantages to this arrangement. The pool bottom beneath the leaf trap is not scoured by the jet action of the sweep hoses, and the collected leaves often leave unsightly stains on the pool bottom beneath the trap. Also, it is awkward to raise the leaf trap in such a way that the leaves do not spill out before the trap reaches the surface.

SUMMARY OF THE INVENTION

According to the present invention, a pool cleaning apparatus is provided which includes a frame having a ballast chamber adapted to be filled with ballast to render the apparatus stationary while it is in operation. The frame includes an annular manifold adapted to be coupled to a source of feed water under pressure, and it also includes a venturi chamber having open upper and lower ends. Venturi jets are provided which are in communication with the manifold and with the venturi chamber. The jets receive a portion of the feed water from the manifold for upward discharge into the venturi chamber.

The apparatus further includes a plurality of support legs which space the lower end of the venturi chamber above a pool bottom for allowing an upward flow of pool water to be induced into the venturi chamber by the upward discharge of feed water from the venturi jets.

The cleaning apparatus further includes a plurality of elongated, flexible jet-reactive sweep hoses in fluid communication with the manifold for receiving a portion of the feed water to sweep the hoses in a sinuous fashion. This tends to place small particles of foreign matter in suspension. The action of the sweep hoses also tends to draw larger debris inwardly toward the venturi chamber. A debris bag attached to the upper end of the venturi chamber collects debris that passes upwardly through the venturi chamber.

The present apparatus is not mobile and therefore does not utilize booster pumps or any of the relatively expensive and complex mechanisms present in many mobile pool cleaning devices to move them across the pool bottom and sides. Instead, the apparatus is manually moved from one location to the other, as may be needed to clean a large pool area. The use of a venturi chamber in combination with sweep hoses eliminates any need for a leaf trap beneath the apparatus, leaves and the like being collected instead in a leaf bag which can be periodically emptied when necessary.

Once placed in a selected location on the pool bottom, the sweep hoses reach adjacent pool bottom areas and place small foreign particles in suspension. Simultaneously, the action of the sweep hoses also draws in larger debris toward the apparatus, the debris being then automatically drawn up into the leaf bag. The apparatus need not be moved over the pool bottom to collect scattered leaves.

Other aspects and advantages of the present invention will become apparent from the following more detailed description taken in conjunction with the accompanying drawings.

BRIEF DESCRIPTION OF THE DRAWINGS

FIG. 1 is a perspective view of the present pool cleaning apparatus in position on the bottom of an in-ground swimming pool;

FIG. 2 is a bottom plan view of the frame of the apparatus;

FIG. 4 is a top plan view of the lower portion of the frame of FIG. 2; and

DESCRIPTION OF THE PREFERRED EMBODIMENT

Figure 3:
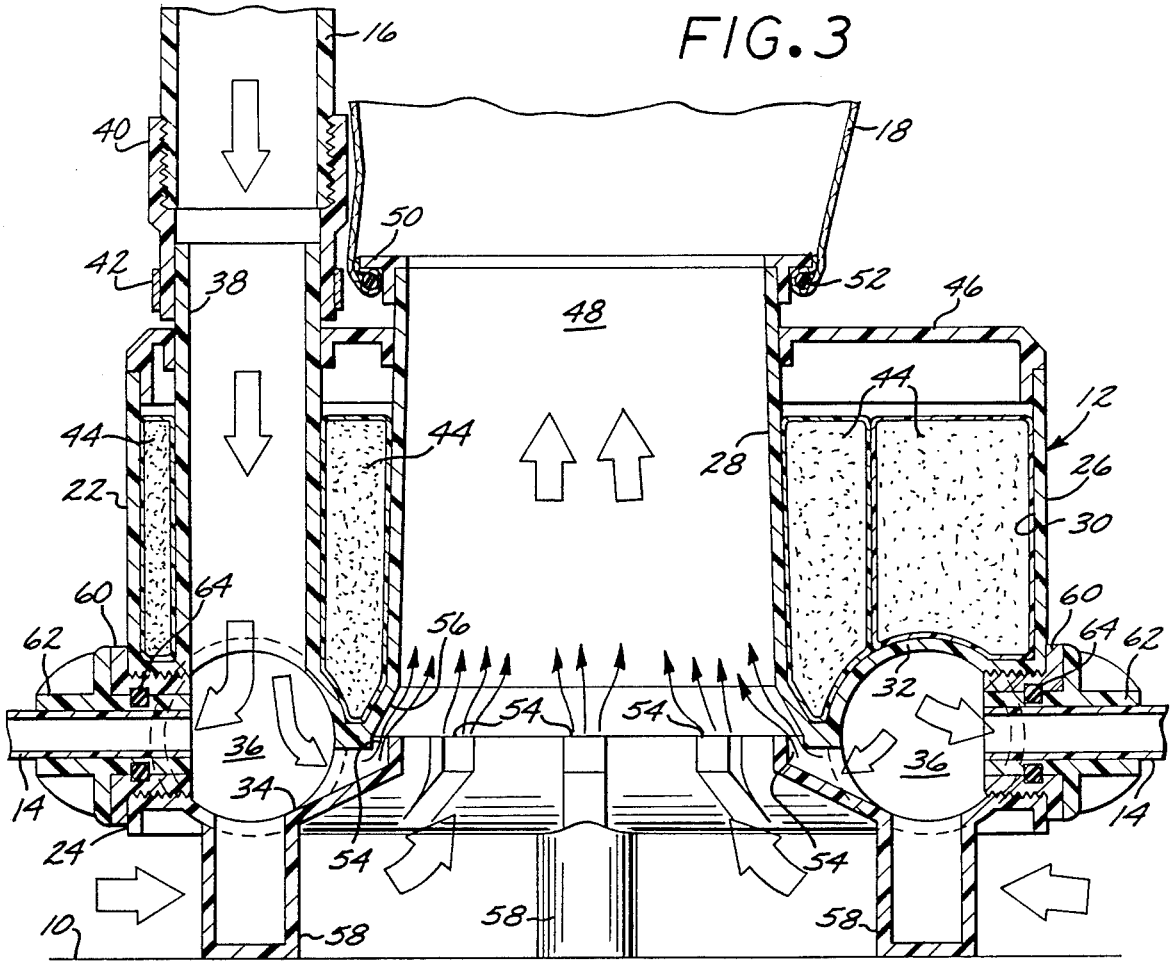
FIG. 3 is an enlarged view taken along the line 3—3 of FIG. 2.

Referring now to the drawings, FIG. 1 illustrates the present pool cleaning apparatus located at a selected site on the bottom 10 of a typical excavated or in-ground pool. As will be seen, the apparatus comprises, generally, a frame 12 which mounts a plurality of elongated, flexible jetreactive sweep hoses 14, the sweep hoses being moved in a sinuous fashion by the reactive effect of water under pressure passing though the hoses. The pressurized water is provided to the frame by a suitable feed hose 16 connected to the pool filtration system (not shown) or other suitable source of water under pressure. Although feed water under pressure could be provided by a submersible pump (not shown) carried by the frame 12 and powered by electrical conduits (not shown) extending to the surface, it is preferred that the source of pressurized water be located at the surface to minimize the bulk of the pool cleaning apparatus.

The flailing action of the sweep hoses 14 establishes a turbulent region at the outer extremities of the hoses. The turbulence diminishes inwardly of the free ends of the hoses such that at the hose inner or root ends the water is relatively calm.

As is well known to those skilled in the art, the sweeping action of the sweep hoses 14 and the action of the water jets emanating from their free ends causes small particles of debris to be placed in suspension for removal by the pool filtration system. Also, the sweeping action of the hoses 14 and the existence of less turbulent water adjacent the frame tends to draw larger debris inwardly toward the frame 12. As will be seen, the present apparatus is adapted to draw up such debris and carry it into a debris collection means in the form of a leaf bag 18 mounted to the top of the frame 12.

The illustrated arrangement of sweep hoses is adapted to clean a 24 foot diameter pool section or, if two of the hoses are made longer, a 15×30 foot section. No booster pump is usually needed because the usual filtration pump is capable of providing sufficient water under pressure.

Once the area adjacent the cleaning apparatus is swept free of debris, the apparatus can be moved by pulling upon the feed hose 16, or by using a conventional telescopable pool pole to forcibly slide the frame 12 to a new location on the pool bottom. Although not shown, handles or other attachments can be provided on the frame to facilitate such relocation of the cleaning apparatus.

Figure 5:
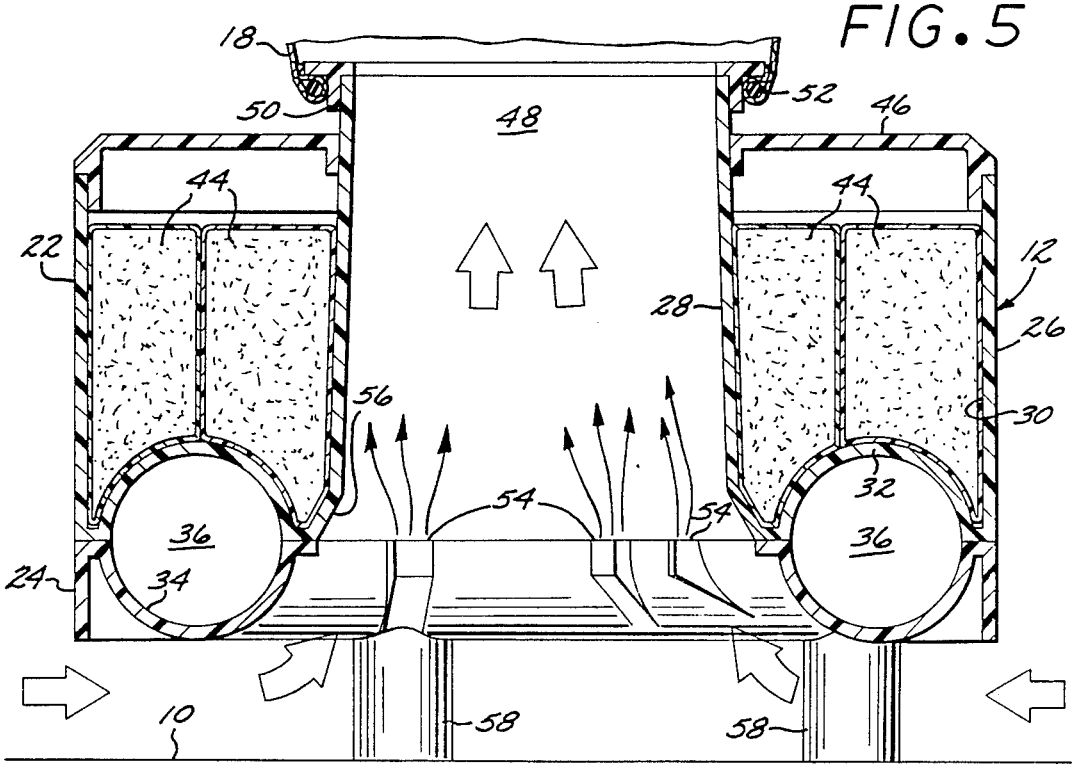
FIG. 5 is an enlarged view taken along the line 5—5 of FIG. 2.

With particular reference to FIGS. 2–5, the present cleaning apparatus includes a housing or frame 12 which is preferably made by assembling an upper frame portion 22 and a lower frame portion 24 by sonic welding, adhesives, or any other suitable means.

The upper frame portion 22 is generally cylindrical in configuration, having an outer wall 26 and an inner wall 28 spaced apart to define an annular weight or ballast chamber 30. The ballast chamber 30 is upwardly open, but is closed at its base by a circumferentially continuous upper manifold wall 32. As will be seen, the upper manifold wall is complementally fitted and sonically welded to a lower manifold wall 34 forming a part of the lower frame portion 24. The mated walls 32 and 34 define a circumferentially continuous cylindrical manifold 36.

The components of the present apparatus are preferably made of molded, high strength plastic material, and a vertically elongated cylindrical delivery tube 36 is molded as an integral part of the upper frame portion 22. The lower end of the delivery tube 38 is open for communication with the interior of the manifold 36. The upper end of the delivery tube is open, and a cylindrical hose cuff 40 is mounted to the upper end of the delivery tube 38 by a cylindrical clamp 42. The upper extremity of the hose cuff is internally threaded to threadably receive the externally threaded lower extremity of a fitting integral with the feed hose 16. This arrangement routes feed water under pressure into the manifold 36, as indicated by the arrows in FIG. 3.

The ballast chamber 30 is adapted to receive any suitable ballast to weigh down the frame 12 and maintain it in position on the pool bottom during normal operation. A preferred form of ballast comprises is a plurality of apertured bags 44 filled with a mixture of sand and cement. When the apparatus is immersed in water, the cement sets and permanently fixes the ballast in place. The open upper end of the ballast chamber 30 is closed by an upper closure or cover 46 is press fitted or otherwise secured in complemental, close fitting relation with the walls 26 and 28 of the frame 12 and the adjacent walls of the delivery tube 38.

The cylindrical inner wall 28 defines a central venturi chamber 48 which is open at the bottom to admit water from the pool and to admit jets of water from a number of jet orifices, as will be seen. The open upper end of the chamber 48 fixedly mounts an annular ring 50 characterized by a radially outwardly directed flange over which is fitted the lower end of the leaf bag 18. A suitable drawstring 52 is carried at the lower end of the bag 44 to secure the bag in position, while yet enabling the bag to be easily removed upon loosening of the drawstring. Large debris passing upwardly through the venturi chamber 48 will be collected in the bag 18, which is apertured or pervious to water so that water can pass back into the pool.

The lower frame portion 24 is molded to include inwardly directed wall sections equally spaced circumferentially around the manifold 36 and defining passageways open at their inner ends to the manifold 36. The outer ends of the passageways are upwardly directed to form venturi orifices 54 which direct jets of water against an upwardly and radially inwardly sloping water deflection wall 56. The wall 56 constitutes the inner lower extremity of the inner wall 28 and it spreads the action of the jets of water throughout the venturi chamber 48 to develop a strong venturi action.

The lower manifold wall 34 includes integrally molded upright supports or legs 58 which space the lower open end of the venturi chamber 48 above the pool bottom. This spacing defines passageways for pool water to flow inwardly and up into the venturi chamber 48. The venturi effect of the streams of rapidly flowing water from the orifices 54 induces a larger volume of pool water to flow up into the chamber 48, carrying with it large items of debris such as leaves.

The plurality of sweep hoses 14 are equally spaced about the periphery of the manifold 36 and are coupled in fluid communication with the interior of the manifold 36 by respective female quick connectors 60 and male quick connectors 62. Each connector 60 is threaded within suitable, complemental threaded openings defined by the interconnected upper and lower frame portions 22 and 24. Each male connector 62 includes a central passageway within which the end of the associated sweep hose 14 is secured, as by suitable adhesives or the like. The cylindrical outer wall of the connector 62 fits closely within the cylindrical inner wall of the associated connector 60, and a suitable sealing means in the form of an O-ring 64 is carried within complemental, confronting annular grooves provided in the connectors 60 and 62. With this arrangement, a portion of the pressurized feed water from the manifold 36 passes into the sweep hoses 14, issuing from the free end of each hose in the form of a jet whose reactive effect causes the hose to move in a sinuous, sweeping fashion over the adjacent surfaces of the pool.

In operation, the pool cleaning apparatus is placed upon the pool bottom approximately in the center of the area to be cleaned. The ballast in the ballast chamber 30 weighs the apparatus down so it is immobile during normal operation. Pressurized water passing from the feed hose 16 into the manifold 36 and a portion passes through the venturi orifices 54, and another portion passes into the sweep hoses 14. The sweeping action of the hoses 14 places small debris particles in suspension for passage to the pool filtration system, while the flow of jet streams from the orifices 54 induces a flow of pool water inwardly toward the frame 12, and upwardly through the venturi chamber 48. This carries larger debris items such as leaves into the leaf bag 18.

The spacing of the lower end of the venturi chamber 48 above the pool bottom not only provides a path for pool water to flow into the leaf bag 18, but also enables the pool bottom beneath the cleaning apparatus to be continually cleansed and scoured by the moving water, eliminating any potential for leaf staining.

Despite its operatively stationary characteristic, the present cleaning apparatus is nonetheless both capable of placing small particles of debris in suspension, while simultaneously drawing up large debris items into the leaf bag 18 for later removal.

Various modifications and changes may be made with regard to the foregoing detailed description without departing from the spirit of the invention.

What is claimed is:

1. Operatively stationary pool cleaning apparatus comprising:

a frame including a manifold adapted to be coupled to a source of feed water under pressure, a venturi chamber having open upper and lower ends, venturi jets in communication with the manifold and the venturi chamber to receive a portion of the feed water from the manifold for upward discharge into the venturi chamber, a support means adapted to rest upon a pool bottom for spacing the lower end of the venturi chamber above the pool bottom for allowing an upward flow of pool water to be induced into the venturi chamber by the upward discharge of feed water into the venturi chamber, and ballast means for constraining the frame against movement relative to the pool bottom;

a plurality of elongated, flexible jet reactive sweep hoses in fluid communication with the manifold for receiving a portion of the feed water to sweep the hoses in a sinuous fashion, tending to place small particles of foreign matter in suspension and tending to draw larger debris toward the venturi chamber for passage into the venturi chamber under the action of the venturi jets; and debris collection means attached to the upper end of the venturi chamber for collecting debris passing through the venturi chamber.

2. Apparatus according to claim 1 wherein the debris collection means comprises a bag removably coupled to the venturi chamber to enable the bag to be separated from the venturi chamber for emptying

3. Apparatus according to claim 2 wherein the lower frame portion carries the venturi jets, and the upper frame portion defines the venturi chamber and includes water deflection surfaces for spreading the upward discharge of feed water throughout the venturi chamber to enhance induction of pool water.

4. Apparatus according to claim 1 wherein the frame comprises upper and lower frame portions joined together and having complemental surfaces defining the manifold.

5. Apparatus according to claim 1 wherein the ballast means includes sand.

6. Apparatus according to claim 1 wherein the ballast means comprises apertured sand and cement filled bags.

7. Operatively stationary pool cleaning apparatus comprising;

a frame including a manifold adapted to be coupled to a source of feed water under pressure, a venturi chamber, venturi jets for discharging feed water from the manifold into the venturi chamber, support means adapted to rest upon a pool bottom for spacing the venturi chamber above the pool bottom to enable a flow of pool water to be induced into the venturi chamber, a ballast means for constraining the frame against movement over the pool bottom;

a plurality of elongated, flexible jet reactive sweep hoses for discharging feed water from the manifold into the pool water, and for sweeping over the pool bottom, and debris collection means carried by the frame for collecting debris carried by pool water induced to flow through the venturi chamber.

8. Apparatus according to claim 7 wherein the debris collection means comprises an apertured bag removably attached to the discharge end of the venturi chamber.

9. Apparatus according to claim 7 wherein the venturi chamber is vertically elongated, cylindrical in cross section and connected at its discharge end to the debris collection means.

10. Apparatus according to claim 7 wherein the outlets from the manifold for the sweep hoses are circumferentially spaced apart and radially outwardly directed, and the outlets for the venturi jets are circumferentially spaced apart and radially inwardly directed.

* * * * *